US009566785B2

(12) United States Patent
Nakahata

(10) Patent No.: US 9,566,785 B2
(45) Date of Patent: Feb. 14, 2017

(54) LIQUID EJECTION HEAD

(71) Applicant: CANON KABUSHIKI KAISHA, Tokyo (JP)

(72) Inventor: Kousuke Nakahata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/991,014

(22) Filed: Jan. 8, 2016

(65) Prior Publication Data

US 2016/0200104 A1 Jul. 14, 2016

(30) Foreign Application Priority Data

Jan. 9, 2015 (JP) ..... 2015-003182

(51) Int. Cl.
*B41J 2/14* (2006.01)

(52) U.S. Cl.
CPC ..... *B41J 2/14016* (2013.01); *B41J 2/14032* (2013.01); *B41J 2/14145* (2013.01); *B41J 2002/14306* (2013.01); *B41J 2002/14403* (2013.01); *B41J 2002/14419* (2013.01)

(58) Field of Classification Search
CPC ..... B41J 2/14016; B41J 2/14145; B41J 2002/14306; B41J 2002/14419
See application file for complete search history.

(56) References Cited

U.S. PATENT DOCUMENTS

2005/0099456 A1* 5/2005 Higa ..... B41J 2/14145 347/44
2012/0007925 A1* 1/2012 Nakahata ..... B41J 2/14145 347/65

FOREIGN PATENT DOCUMENTS

JP 07-156403 A 6/1995
JP 2962726 B2 10/1999

* cited by examiner

*Primary Examiner* — Geoffrey Mruk
(74) *Attorney, Agent, or Firm* — Fitzpatrick, Cella, Harper & Scinto

(57) ABSTRACT

A liquid ejection head includes a plurality of pressure chambers having respective ejection ports for ejecting liquid, a common liquid chamber communicating with the plurality of pressure chambers through individual liquid paths for supplying liquid to the respective pressure chambers, and a plurality of energy generating elements provided in the respective pressure chambers. The common liquid chamber has a first surface provided with the liquid paths and a second surface arranged vis-à-vis the first surface. Pressure waves sequentially generated with a time difference propagate from the respective liquid paths and are reflected by the second surface. The second surface has an inclined portion inclined relative to the first surface by a predefined inclination angle such that each pressure wave is returned to the first surface in a time not agreeing with the time difference.

9 Claims, 8 Drawing Sheets

FIG. 3
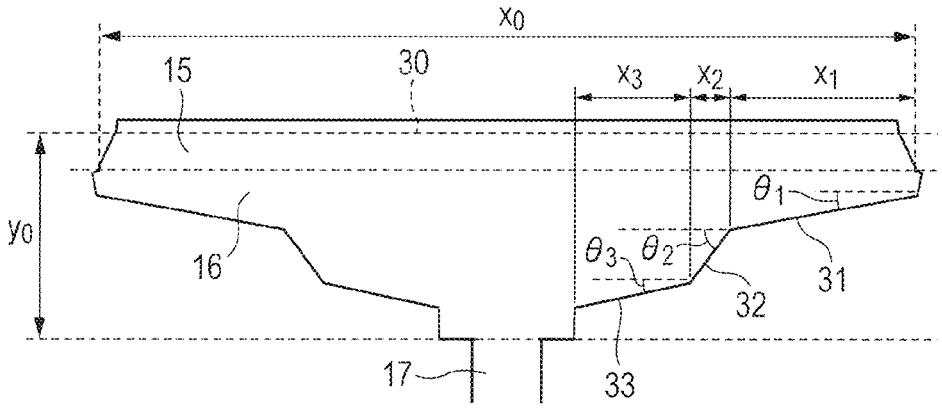
FIG. 4
| θ | | | x | | | | y |
|---|---|---|---|---|---|---|---|
| $\theta_1$ | $\theta_2$ | $\theta_3$ | $x_0$ | $x_1$ | $x_2$ | $x_3$ | $y_0$ |
| 8° | 45° | 8° | 23320 μm | 4895 μm | 1158 μm | 3227 μm | 4600 μm |
FIG. 5
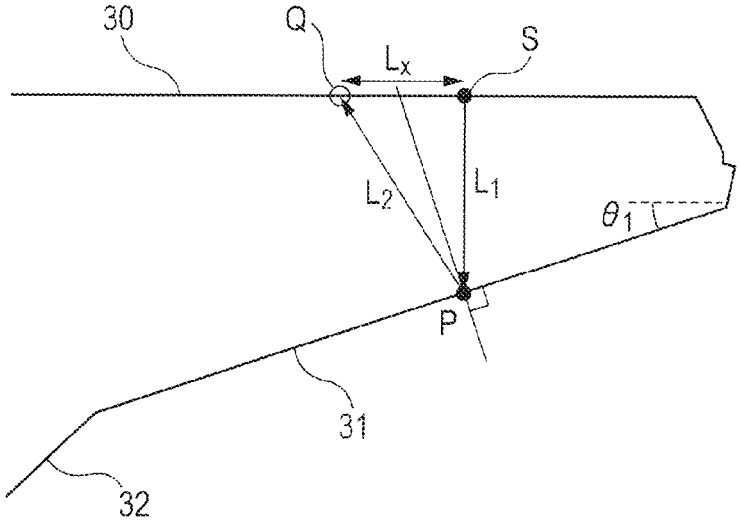

FIG. 6
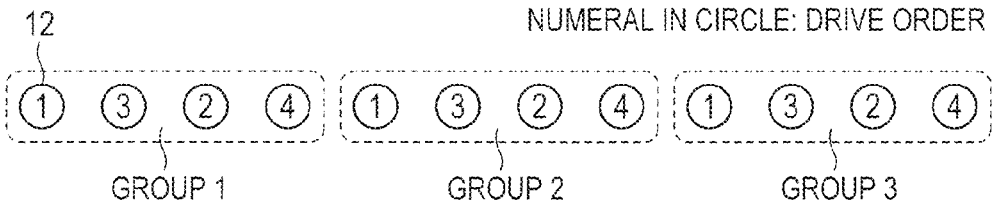
FIG. 7
| | | | | | | | | | | | | | | | | | |
|---|---|---|---|---|---|---|---|---|---|---|---|---|---|---|---|---|---|
| EVEN | Seg. | 0 | 2 | 4 | 6 | 8 | 10 | 12 | 14 | 16 | 18 | 20 | 22 | 24 | 26 | 28 | 30 |
| | DRIVE BLOCK | 14 | 8 | 2 | 12 | 6 | 16 | 10 | 4 | 15 | 9 | 3 | 13 | 7 | 1 | 11 | 5 |
| ODD | Seg. | 1 | 3 | 5 | 7 | 9 | 11 | 13 | 15 | 17 | 19 | 21 | 23 | 25 | 27 | 29 | 31 |
| | DRIVE BLOCK | 1 | 11 | 5 | 15 | 9 | 3 | 13 | 7 | 2 | 12 | 6 | 16 | 10 | 4 | 14 | 8 |
FIG. 8
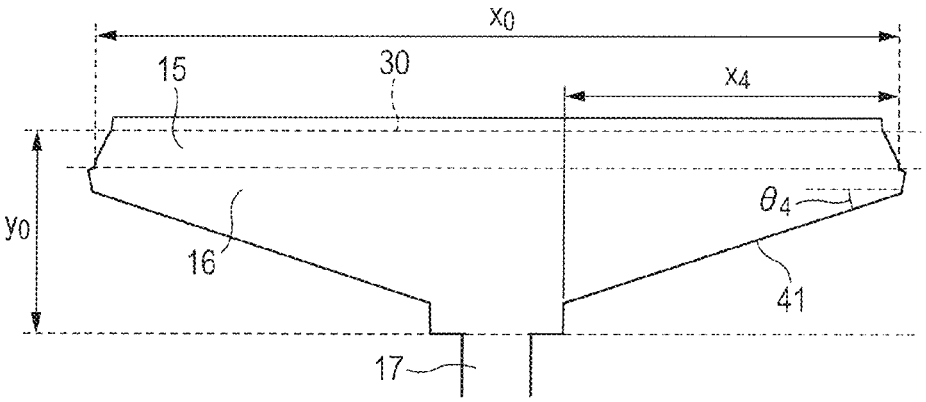
FIG. 9
| $\theta$ | x | | y |
|---|---|---|---|
| $\theta_4$ | $x_0$ | $x_4$ | $y_0$ |
| 14° | 23320 $\mu$m | 9280 $\mu$m | 4600 $\mu$m |

FIG. 17
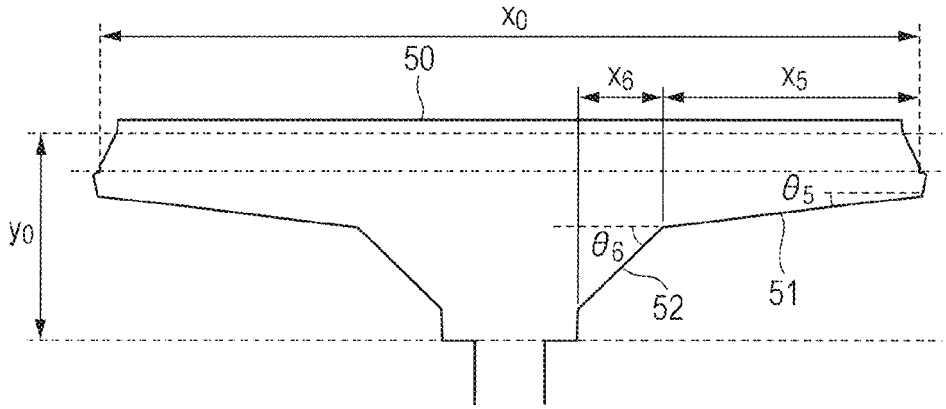
FIG. 18
| θ | | x | | | y |
|---|---|---|---|---|---|
| $\theta_5$ | $\theta_6$ | $x_0$ | $x_5$ | $x_6$ | $y_0$ |
| 5° | 45° | 23320 μm | 7271 μm | 2009 μm | 4600 μm |
FIG. 19
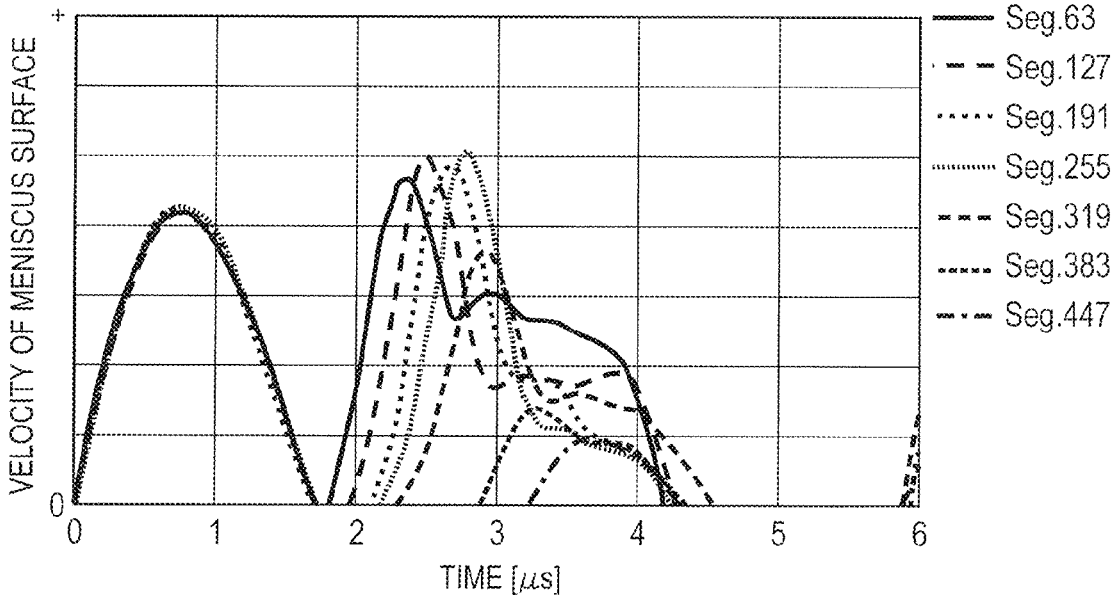

LIQUID EJECTION HEAD

BACKGROUND OF THE INVENTION

Field of the Invention

The present invention relates to a liquid ejection head having a plurality of ejection ports.

Description of the Related Art

The known liquid ejection methods include the thermal method and the piezoelectric method. The thermal method utilizes electro-thermal conversion elements (heaters) as energy generating elements in order to generate energy necessary for ejecting liquid. The piezoelectric method, on the other hand, utilizes piezoelectric elements (piezos) as energy generating elements. Liquid ejection heads that are based on either of these methods generally include a plurality of liquid ejection ports, a plurality of pressure chambers each of which communicates with the corresponding one of the ejection ports and a common liquid chamber for storing liquid to be supplied to the individual pressure chambers. The energy generating elements are arranged in the respective pressure chambers.

When a liquid ejection head of either of the above-described types is in operation, a pressure wave of liquid appears as the energy generating element in one of the pressure chambers is driven. The pressure wave then propagates to the remaining pressure chambers containing the respective energy generating elements by way of the common liquid chamber. Then, there can be instances where meniscus vibrations take place at the ejection ports of the remaining pressure chambers. As liquid is ejected in a condition where meniscuses are vibrating to a large extent, the ejected liquid droplets can represent variations in terms of volume, moving speed and moving direction depending on the height and the vibration velocity of the meniscuses. As the ejected liquid droplets represent variations in terms of volume, moving speed and moving direction in this way, degraded images can be recorded by the liquid ejection head because such variations entail density variations of recorded images and generation of streaky defective images. Additionally, as the meniscuses rise excessively, the ejection ports forming plane can become broadly wetted to consequently give rise to variations of liquid ejecting direction and a liquid-unejectable state.

Pressure waves as described above can be classified into two groups of pressure waves according to the difference of propagation route. One is a group of pressure waves that directly propagate from the pressure chambers where pressure waves are generated to adjacently located pressure chambers, which are referred to as directly propagating waves. The other is a group of pressure waves that propagate to the common liquid chamber and are subsequently reflected by one of the wall surfaces of the common liquid chamber to propagate to other pressure chambers, which are referred to as wall surface-reflected waves.

The magnitude of meniscus vibrations attributable to directly propagating waves depends on the distance by which pressure chambers are separated from each other. Therefore, the influence of directly propagating waves is small between two pressure chambers that are separated from each other by a large distance. Additionally, the meniscus vibrations generated by directly propagating waves survive only a short period of time after the generation of the directly propagating waves. Thus, liquid ejections by a liquid ejection head can be made to be hardly influenced by directly propagating waves by maximizing the drive time differences of the energy generating elements arranged in the respective pressure chambers that are located close to each other by adopting an energy generating element drive technique referred to as time division drive.

On the other hand, meniscus vibrations attributable to wall surface-reflected waves depend on the reflection behavior of the pressure waves. More specifically, the magnitude and the peak time of meniscus vibrations vary to a large extent depending on the starting points of the wall surface-reflected waves, the distances from the wall surface of the common liquid chamber that reflects pressure waves and the angle of the wall surface. With the above-described time division drive, it is difficult to cause the drive time difference to finely vary as a function of the position of energy generating element because of the characteristics of the drive method. Therefore, it is difficult to realize a drive situation where all the energy generating elements are made be hardly affected by wall surface-reflected waves.

Japanese Patent No. 2962726 and Japanese Patent Application Laid-Open No. H07-156403 disclose techniques for solving the problem of defective liquid ejections attributable to wall surface-reflected waves as described above. With the techniques described in Japanese Patent No. 2962726 and Japanese Patent Application Laid-Open No. H07-156403, it is possible to cause a common liquid chamber to trap air bubbles in the inside thereof and make the trapped air bubbles absorb the pressure fluctuations in the inside of the common liquid chamber by the pressure buffering effect of the air bubbles.

When utilizing the pressure buffering effect of air bubbles by means of the techniques as described in Japanese Patent No. 2962726 and Japanese Patent Application Laid-Open No. H07-156403, it is difficult to maintain the volume of the air bubbles in the common liquid chamber to a constant level for a long period of time. Then, by turn, it is difficult to maintain the pressure buffering effect on a stable basis.

It is therefore the object of the present invention to provide a liquid ejection head that can reliably and stably suppress defective ejections attributable to the pressure waves reflected by one of the wall surfaces of the common liquid chamber of the liquid ejection head.

SUMMARY OF THE INVENTION

According to the present invention, the above object is achieved by providing a liquid ejection head including: a substrate having a plurality of pressure chambers formed therein, the pressure chambers having respective ejection ports for ejecting liquid; a common liquid chamber communicating with the plurality of pressure chambers; and a plurality of energy generating elements arranged respectively in the plurality of pressure chambers to generate energy necessary for ejecting liquid from the respective ejection ports, the liquid being supplied from the common liquid chamber to the pressure chambers; the liquid ejection head being configured to cause pressure waves generated as a result of sequentially driving the plurality of energy generating elements with a predefined time difference to propagate from respective starting points on a first surface of the common liquid chamber located at the side of the substrate, the starting points corresponding to the positions of the respective energy generating elements, in a direction perpendicular to the first surface so as to be reflected by a second surface of the common liquid chamber arranged oppositely relative to the first surface and returned to the respective end points on the first surface, the second surface being provided with an inclined portion inclined relative to the first surface by a predefined inclination angle such that each pressure wave propagates from the starting point to the end point in a time either shorter or longer than the time difference.

Thus, according to the present invention, the inclined portion of the second surface of the common liquid chamber is so formed as to prevent the pressure wave propagation time from agreeing with the drive time difference no matter which one of the energy generating elements is driven. Therefore, any possible amplification of meniscus vibrations that are attributable to overlapping of pressure waves can reliably be suppressed.

Further features of the present invention will become apparent from the following description of exemplary embodiments with reference to the attached drawings.

BRIEF DESCRIPTION OF THE DRAWINGS

FIG. 3 is a schematic cross-sectional view of the first embodiment taken along the cutting line i-i' illustrated in FIG. 1.

FIG. 4 is a table of dimensions relating to the wall surfaces of the common liquid chamber illustrated in FIG. 3.

FIG. 5 is an enlarged schematic view of the first inclined portion and its vicinity illustrated in FIG. 3.

FIG. 6 is a schematic illustration of grouped energy generating elements.

FIG. 7 is a table of drive blocks of energy generating elements.

FIG. 8 is a schematic cross-sectional view of a liquid ejection head represented as an example for comparison.

FIG. 9 is a table of dimensions relating to the wall surfaces of the common liquid chamber illustrated in FIG. 8.

FIG. 17 is a schematic cross-sectional view of a second embodiment of liquid ejection head according to the present invention.

FIG. 18 is a table of dimensions relating to the wall surfaces of the common liquid chamber illustrated in FIG. 17.

FIG. 19 is a graph illustrating the relationship between the time that has elapsed since the generation of each of the pressure waves and the corresponding meniscus vibration velocity of the second embodiment of liquid ejection head according to the present invention.

DESCRIPTION OF THE EMBODIMENTS

Preferred embodiments of the present invention will now be described in detail in accordance with the accompanying drawings.

First Embodiment

Figure 1:
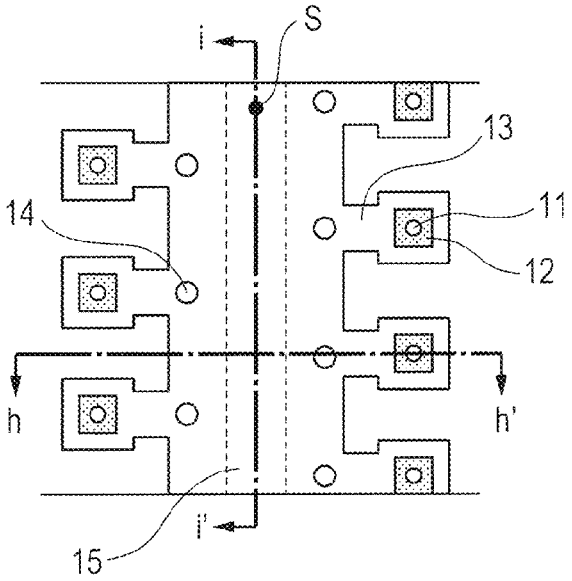
FIG. 1 is a schematic plan view of a first embodiment of liquid ejection head according to the present invention as viewed from the ejection ports forming surface side thereof.
Figure 2:
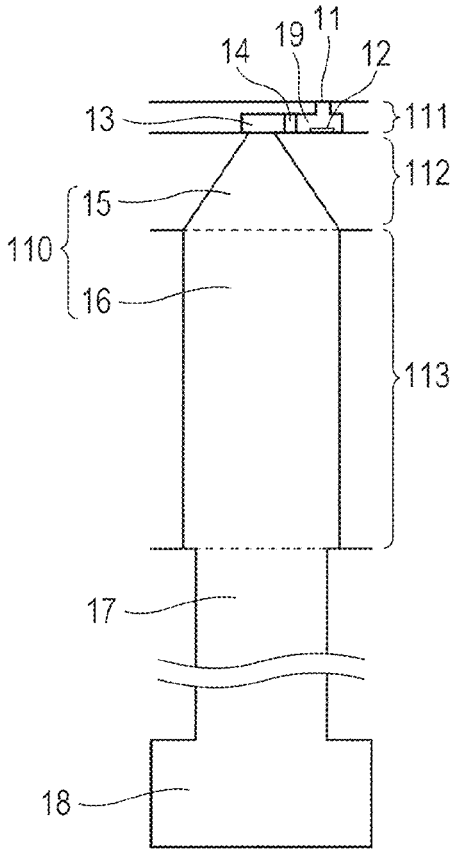
FIG. 2 a schematic cross-sectional view of the first embodiment taken along the cutting line h-h' illustrated in FIG. 1.

FIG. 1 is a schematic plan view of the first embodiment of liquid ejection head according to the present invention as viewed from the ejection ports forming surface side thereof. FIG. 2 is a schematic cross-sectional view of the first embodiment taken along the cutting line h-h' illustrated in FIG. 1.

In the liquid ejection head of this embodiment, the ink contained in tank 18 is supplied to a second common liquid chamber 16 by way of supply channel 17 as illustrated in FIG. 2. The ink in the second common liquid chamber 16 is then supplied to a first common liquid chamber 15. Note that, the common liquid chamber 110 of this embodiment that can store ink is constituted by the first common liquid chamber 15 and the second common liquid chamber 16. The first common liquid chamber 15 is held in communication with a plurality of liquid paths 13. A filter 14 for removing foreign objects, if any, contained in the supplied ink is arranged in each of the liquid paths 13. The ink that passes through the filter 14 in the liquid path 13 then flows into the corresponding one of the pressure chambers 19. An energy generating element 12 is arranged in each of the pressure chambers 19. A total of 1024 energy generating elements 12 are provided in this embodiment. An ejection port 11 is provided for each of the energy generating elements and arranged at a position located vis-à-vis the energy generating element 12. The liquid paths 13, the pressure chambers 19 and the ejection ports 11 are formed in a first substrate 111. The first common liquid chamber 15 is formed in a second substrate 112. The second common liquid chamber 16 is formed in a third substrate 113. The first substrate 111, the second substrate 112 and the third substrate 113 are laid one on the other in the above-mentioned order. In this embodiment, the energy generating elements 12 are heat-generating elements, each of which can generate thermal energy necessary for ejecting ink from the related ejection port 11. As any one of the energy generating elements 12 generates heat according to an input drive signal, the ink located near the element bubbles and then the ink is ejected from the related ejection port 11 under the pressure of the generated air bubbles. According to the present invention, the energy generating elements 12 may be piezoelectric elements.

FIG. 3 is a schematic cross-sectional view of the first embodiment taken along the cutting line i-i' illustrated in FIG. 1. The cutting line i-i' extends along the center line of the first common liquid chamber 15. As illustrated in FIG. 3, the wall surface of the second common liquid chamber 16 is so arranged as to face a first surface 30 of the first common liquid chamber 15, which first surface 30 is located vis-à-vis the first substrate 111, (the surface where communicating sections that communicate with the respective ejection ports 11 are formed). The wall surface of the second common liquid chamber 16 includes three inclined portions that are inclined relative to the first surface 30. More specifically, the three inclined portions include a first inclined portion 31, a second inclined portion 32 and a third inclined portion 33. The second inclined portion 32 is directly extended from the first inclined portion 31 and located remoter from the first surface 30 than the first inclined portion. The third inclined portion 33 is directly extended from the second inclined portion 32 and located remoter from the first surface 30 than the second inclined portion 32. In the following description, the inclination angle formed by the first inclined portion 31 and the first surface 30 is expressed by $\theta_1$ and the inclination angle formed by the second inclined portion 32 and the first surface 30 is expressed by $\theta_2$, while the inclination angle formed by the third inclined portion 33 and the first surface 30 is expressed by $\theta_3$. The length of the first inclined portion 31 in the horizontal direction is expressed by $x_1$ and the length of the second inclined portion 32 in the horizontal direction is expressed by $x_2$, while the length of the third inclined portion 33 in the horizontal direction is expressed by $x_3$. The length in the vertical direction of the first common liquid chamber 15 and the second common liquid chamber 16 in combination is expressed by $y_0$. FIG. 4 is a table of dimensions relating to the wall surfaces of the common liquid chamber illustrated in FIG. 3.

FIG. 5 is an enlarged schematic view of the first inclined portion and its vicinity illustrated in FIG. 3. Now, the propagation route of a pressure wave (wall surface-reflected wave) will be described below by referring to FIG. 5. In FIG. 5, point S indicates the starting point of a pressure wave that is predefined on the first surface 30 so as to correspond to the position of one of the plurality of energy generating elements 12. Such a point S is predefined for each of the energy generating elements 12. The source of generation of a pressure wave is found in an energy generating element 12. Therefore, the starting point of a pressure wave is supposed to be located in an energy generating element 12. However, for the purpose of the present invention, the starting point of a pressure wave is predefined on the first surface 30 of the first common liquid chamber 15 that faces the first substrate 111 for the sake of convenience. In this embodiment, each starting point is predefined at the intersection of the straight line segment extending from the corresponding one of the energy generating elements 12 to the first common liquid chamber 15 and the center line (cutting line i-i') of the first common liquid chamber 15. However, for the purpose of the present invention, the starting point S may alternatively be predefined at some other arbitrarily selected point on the first surface 30. Point P refers to the point at which a pressure wave that progresses from the starting point S in a direction perpendicular to the first surface 30 contacts (and is reflected by) the first inclined portion 31. Point Q refers to the end point that is predefined on the first surface 30 at which the pressure wave reflected by the first inclined portion at the point P terminates. The propagation time $t_R$ for a pressure wave starting from the point S and returning to the point Q is determined by the formula represented below:

$$t_R = L_1 + L_2/c$$

where $L_1$ is the linear distance from the point S to the point P and $L_2$ is the linear distance from the point P to the point Q, which can be reduced to $L_1/\cos 2\theta_1$, while c is the sound velocity in the liquid stored in the common liquid chamber 110.

Now, the energy generating element drive method of this embodiment will be described below by referring to FIGS. 6 and 7. FIG. 6 is a schematic illustration of grouped energy generating elements 12. As illustrated in FIG. 6, a predefined number of adjacently located energy generating elements 12 are grouped so as to produce a plurality of groups of energy generating elements. A drive order is predefined for the energy generating elements 12 of each of the groups and the energy generating elements 12 are driven sequentially with a predefined time difference. In the following description, the drive order will be referred to as drive block and the time difference between two successive drive blocks will be referred to as block interval. In FIG. 6, a total of twelve energy generating elements 12 are divided into three groups and each of the groups are made to contain preset four drive blocks. The liquid ejection head of this embodiment actually includes a total of 1024 energy generating elements 12 and has 16 drive blocks to make the number of energy generating elements belonging to a single drive block equal to 32.

FIG. 7 is a table of drive blocks of energy generating elements 12. Referring to FIG. 7, Seg. N (N being a numeral) refers to the identification number that is assigned to an energy generating element 12 arranged at a specific position. As illustrated in FIG. 1, the energy generating elements 12 of this embodiment are arranged in two rows with the first common liquid chamber 15 interposed between them. In the table of FIG. 7, the row of the energy generating elements 12 having even Reg. numbers such as Seg. 0, 2, 4 . . . 30 will be referred to as EVEN row. On the other hand, the row of the energy generating elements 12 having odd Reg. numbers such as Seg. 1, 3, 5 . . . 31 will be referred to as ODD row. Different drive blocks are predefined for the EVEN row and the ODD row and a group of energy generating elements is formed by the above 32 energy generating elements including the energy generating elements of the EVEN row and those of the ODD row. The above description on drive blocks is applicable to all the remaining energy generating elements 12 that correspond to Seg. 32 and the succeeding numbers.

Example for Comparison

FIG. 8 is a schematic cross-sectional view of a liquid ejection head represented as an example for comparison. In FIG. 8, the components same as those of the liquid ejection head of the first embodiment are denoted respectively by the same reference symbols. As illustrated in FIG. 8, the second common liquid chamber 16 of the example for comparison has an inclined portion 41 representing a constant inclination angle. The length in the horizontal direction of the inclined portion 41 is indicated by $x_4$. The angle formed by the inclined portion 41 and the first surface 30 is indicated by $\theta_4$. FIG. 9 is a table of dimensions relating to the wall surfaces of the common liquid chamber illustrated in FIG. 8.

Figure 10:
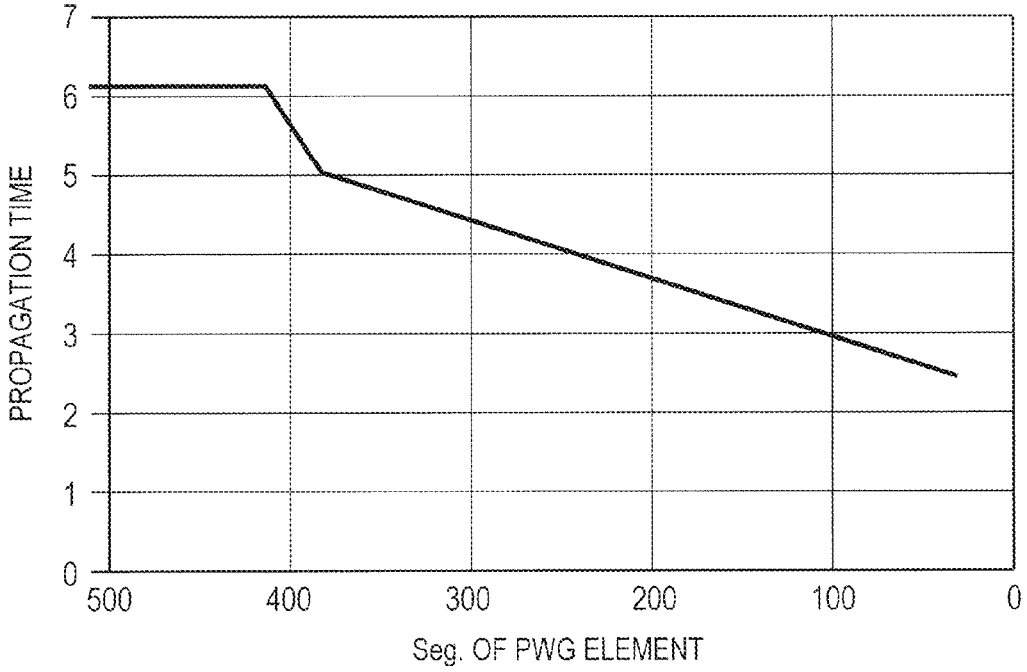
FIG. 10 is a graph illustrating the relationship between each of the pressure wave generating elements and the propagation time of the pressure wave generated by the pressure wave generating element of the liquid ejection head represented as an example for comparison.

FIG. 10 is a graph illustrating the relationship between each of the pressure wave generating elements and the propagation time of the pressure wave generated by the pressure wave generating element of the liquid ejection head represented as an example for comparison. FIG. 10 illustrates the propagation time $t_R$ of each of the pressure waves generated by the energy generating elements 12 with Seg. 0 through Seg. 511. The propagation time $t_R$ is determined by the mathematical formula 1 represented above.

Figure 11:
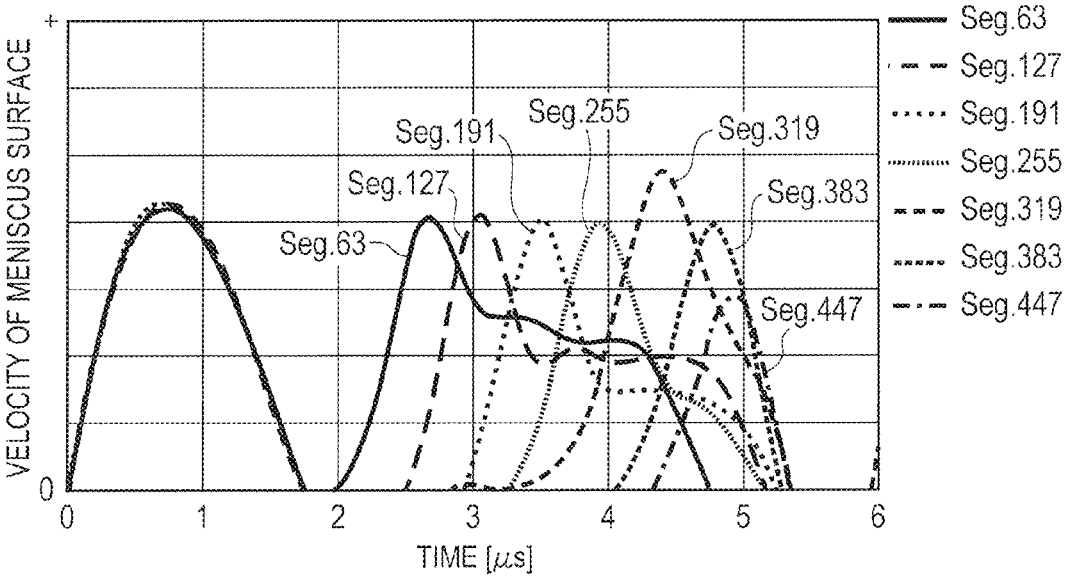
FIG. 11 is a graph illustrating the relationship between the time that has elapsed since the generation of each of the pressure waves and the corresponding meniscus vibration velocity of the liquid ejection head represented as an example for comparison.

FIG. 11 is a graph illustrating the relationship between the time that has elapsed since the generation of each of the pressure waves and the corresponding meniscus vibration velocity of the liquid ejection head represented as an example for comparison. FIG. 11 illustrates the meniscus vibration velocity at a specific ejection port 11 that does not eject liquid when the 64 energy generating elements 12 that belong to a first drive block are driven simultaneously. Additionally, FIG. 11 illustrates the meniscus vibration velocities at the ejection ports 11 that correspond to the energy generating elements 12 that belong to an eighth drive block.

Figure 12:
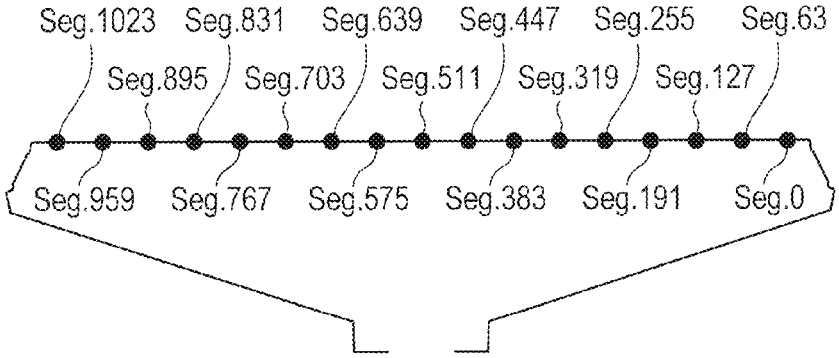
FIG. 12 is a schematic illustration of the positional relationship of the energy generating elements of the liquid ejection head represented as an example for comparison.

Referring to FIG. 11, the meniscus vibrations that represent a peak about 0.8 μs after the generation of a pressure wave are attributable to a directly propagating wave. On the other hand, the meniscus vibrations that represent a peak more than about 2 μs after the generation of a pressure wave are attributable to a wall surface-reflected wave. The latter meniscus vibrations appear substantially at regular intervals in the order of Seg. 63 through Seg. 447. FIG. 12 is a schematic illustration of the positional relationship of the energy generating elements of the liquid ejection head represented as an example for comparison.

Figure 13:
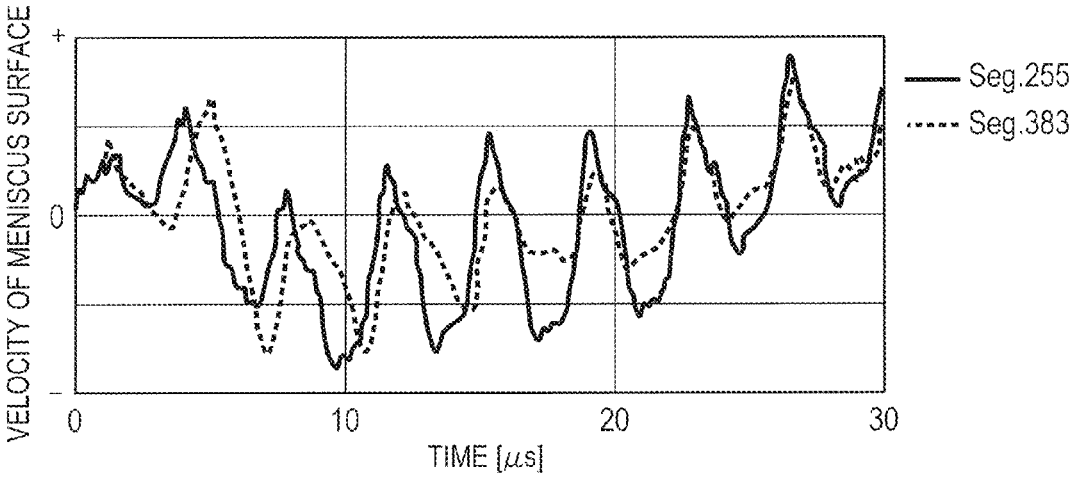
FIG. 13 is a graph illustrating the fluctuations with time of two meniscus vibration velocities.

FIG. 13 is a graph illustrating the fluctuations with time of two meniscus vibration velocities. FIG. 13 illustrates the meniscus vibration velocities that will be observed when the liquid ejection head of the example for comparison, in which the block interval is predefined so as to be 3.8 μs, is driven continuously. For Seg. 255, the peak of meniscus vibrations attributable to a wall surface-reflected wave as illustrated in FIG. 11 comes about at time 3.9 μs, which is substantially equal to the block interval value (3.8 μs). Therefore, when liquid is ejected continuously, meniscus vibrations are amplified as the wall surface-reflected waves, which appear repeatedly, overlap each other. On the other hand, Seg. 383, for which the peak of meniscus vibrations attributable to a wall surface-reflected wave comes about at time 4.9 μs, does not represent any amplification of meniscus vibrations.

When the angle of the inclined portion 41 represents a constant value as in this example for comparison, the propagation time $t_R$ of a wall surface-reflected wave gradually increases from the energy generating elements 12 located at the opposite ends of the rows of the elements toward the energy generating elements 12 located at the center of the rows of the elements (see FIG. 10). When the block interval is predefined so as to be shorter than 3.8 μs, amplification of meniscus vibrations occurs at the ejection ports 11 that correspond to the energy generating elements 12 located nearer to the ends than the energy generating element of Seg. 255. When the block intervals are made to be greater than 3.8 μs, amplification of meniscus vibrations occurs at the ejection ports 11 that correspond to the energy generating elements 12 located nearer to the center than the energy generating element of Seg. 255. In other words, when the inclination angle of the wall surface that reflects pressure waves represents a constant value, amplification of meniscus vibrations occurs due to a wall surface-reflected wave regardless if the block intervals are made to be greater than 3.8 μs or smaller than 3.8 μs.

The upper limit value of block intervals that can be predefined for time-division drive is obtained by dividing the reciprocal number of the drive frequency of the energy generating elements 12 by the number of the drive blocks. When the tendency of increasing the drive frequency that is observed in recent years as a result of the demand for higher speed recording operations is taken into consideration, it is not possible to use remarkably large block intervals. When the block intervals are made too small, on the other hand, it is no longer possible to avoid the influence of meniscus vibrations attributable to directly propagating waves. Thus, the degree of freedom for block intervals is not very high when time division drive is adopted. Therefore, as described above, it is difficult to avoid the problem of amplification of wall surface-reflected waves only by adjusting the block intervals.

Figure 14:
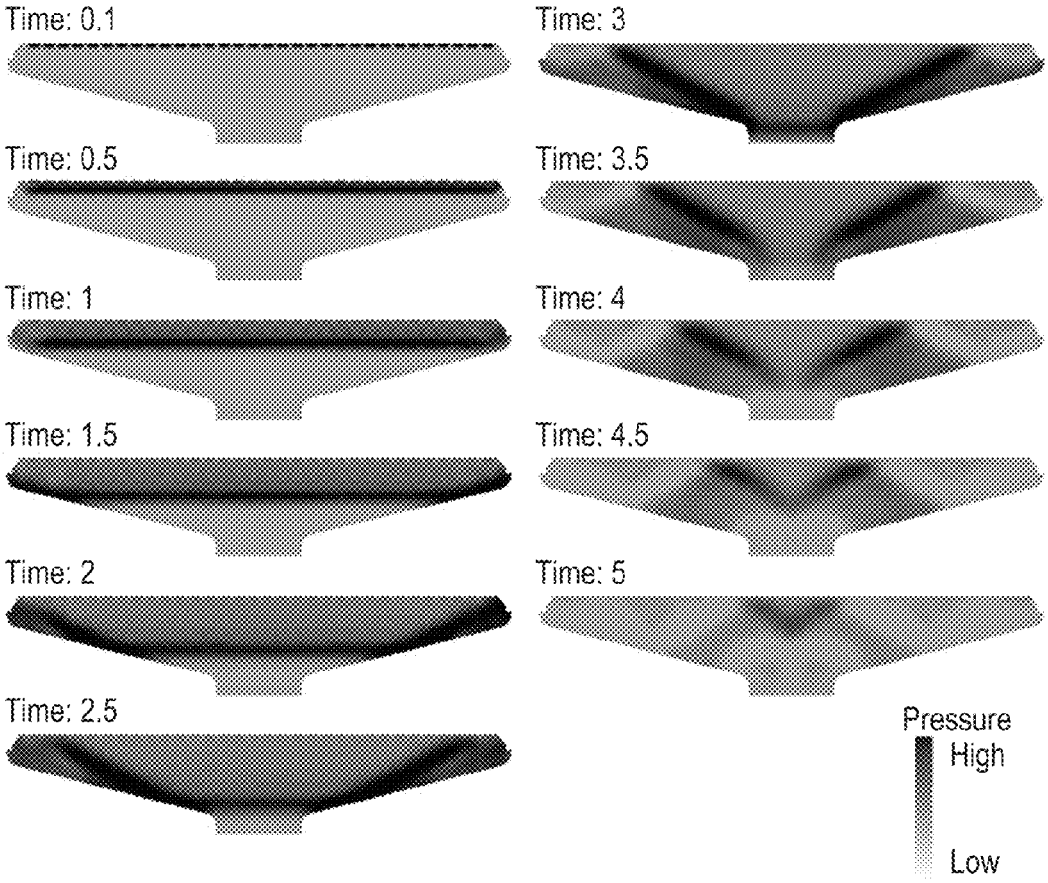
FIG. 14 is a schematic illustration of the results of numerical computations representing how pressure waves propagate in the liquid ejection head illustrated in FIG. 8 as an example for comparison.

FIG. 14 is a schematic illustration of the results of numerical computations representing how pressure waves propagate in the liquid ejection head illustrated in FIG. 8 as an example for comparison. More specifically, FIG. 14 illustrates how pressure waves propagate in the common liquid chamber when all the 64 energy generating elements belonging to a single drive block are driven simultaneously. FLUENT (registered trade mark) of ANSYS Inc. is employed for the numerical computations. How the pressure waves generated in a plurality of energy generating elements propagate downwardly in the vertical direction in the inside of the common liquid chamber is illustrated at the left side of FIG. 14, whereas how the pressure waves reflected by the wall surface of the common liquid chamber propagate upwardly is illustrated at the right side of FIG. 14. FIG. 14 illustrates that the pressure waves generated in a plurality of energy generating elements propagate in the inside of the common liquid chamber substantially as plane waves.

Figure 15:
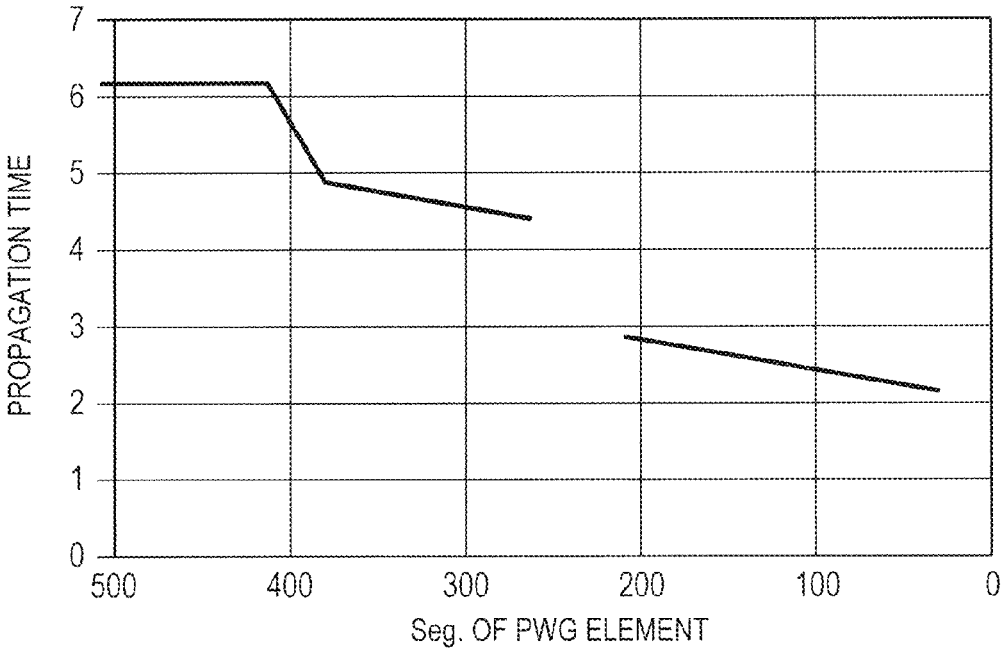
FIG. 15 is a graph illustrating the relationship between each of the pressure wave generating elements and the propagation time of the pressure wave generated by the pressure wave generating element of the first embodiment of liquid ejection head according to the present invention.
Figure 16:
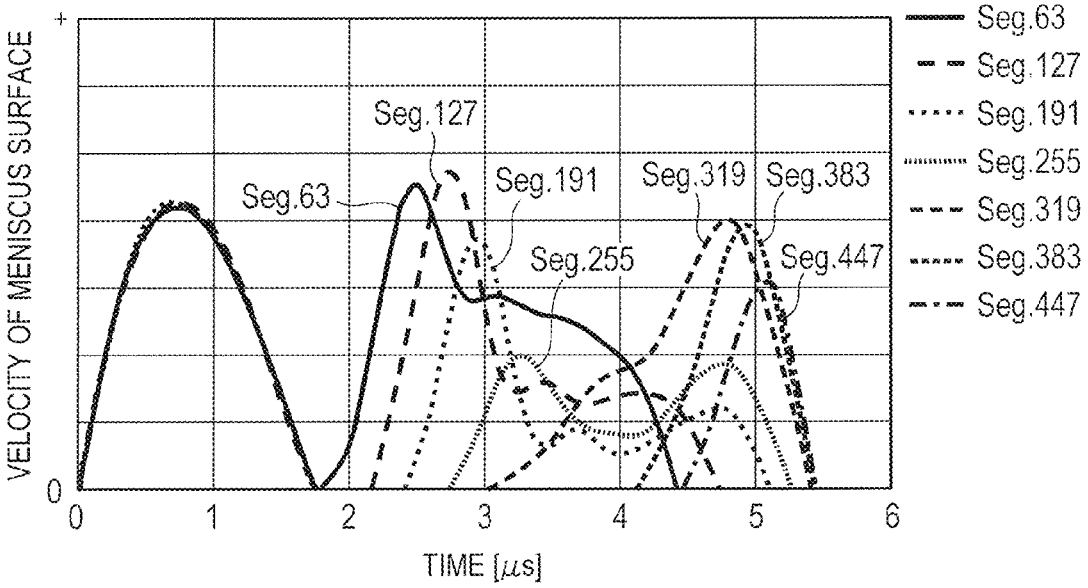
FIG. 16 is a graph illustrating the relationship between the time that has elapsed since the generation of each of the pressure waves and the corresponding meniscus vibration velocity of the first embodiment of liquid ejection head according to the present invention.

FIG. 15 is a graph illustrating the relationship between each of the pressure wave generating elements and the propagation time of the pressure wave generated by the pressure wave generating element of the first embodiment of liquid ejection head according to the present invention. FIG. 16 is a graph illustrating the relationship between the time that has elapsed since the generation of each of the pressure waves and the corresponding meniscus vibration velocity of the first embodiment of liquid ejection head according to the present invention. The block interval of this embodiment is predefined to be 3.8 μs, which is equal to the block interval of the example for comparison. As illustrated in FIG. 15, the pressure waves generated by the energy generating elements that correspond to Seg. 211 through Seg. 265 are reflected by the second inclined portion 32. Since the angle $\theta_2$ is equal to 45°, all the pressure waves reflected by the second inclined portion 32 then propagate in the horizontal direction according to the results of the numerical computations and hence do not return to the ejection ports forming surface side. Thus, no propagation time $t_R$ exists for the pressure waves generated by the energy generating elements 12 of Seg. 211 through Seg. 265.

As illustrated in FIG. 15, the propagation time $t_R$ of the first embodiment is found within the range between about 2.1 μs and about 2.8 μs or within the range between about 4.5 μs and about 6.2 μs. In other words, the propagation time $t_R$ is either greater or smaller than the block interval (3.8 μs) regardless of the position of the point S. Additionally, as illustrated in FIG. 16, the times when the peaks of meniscus vibrations that are attributable to wall surface-reflected waves come are concentrated within the range between about 2.0 μs and about 3.0 μs or within the range between about 4.5 μs and about 5.0 μs.

In the above-described embodiment, the first inclined portion, the second inclined portion and the third inclined portion are formed in the second common liquid chamber 16 such that the propagation time $t_R$ of a wall surface-reflected wave does not agree with the block interval of the energy generating elements 12 regardless of the energy generating element 12 that is driven or the energy generating elements 12 that are driven in each of the groups. Since the profile of each of the inclined portions is invariable, amplification of meniscus vibrations that are attributable to overlapping of repeatedly generated wall surface-reflected waves can reliably be suppressed. Therefore, as a result, defective ejections attributable to pressure waves reflected by the wall surface of the second common liquid chamber 16 can reliably be suppressed. Note that, according to the present invention, the absolute value of the difference between the propagation time $t_R$ and the block interval is desirably greater than, for instance, 0.5 μs (predefined time) so as to suppress amplification of meniscus vibrations more reliably.

Second Embodiment

FIG. 17 is a schematic cross-sectional view of the second embodiment of a liquid ejection head according to the present invention. The second embodiment will now be described below mainly in terms of differences between the first embodiment and the second embodiment and the arrangements of the second embodiment that are similar to those of the first embodiment will not be described in detail.

In this embodiment, the block interval is predefined to be equal to 5.1 μs. In accordance with the predefinition of the value of the block interval, the second common liquid chamber 16 of this embodiment is made to have a first inclined portion 51 and a second inclined portion 52, the distance from the second inclined portion 52 to the ejection ports forming surface 50 being greater than the distance from the first inclined portion 51 to the ejection ports forming surface. FIG. 18 is a table of dimensions relating to the wall surfaces of the common liquid chamber illustrated in FIG. 17.

FIG. 19 is a graph illustrating the relationship between the time that has elapsed since the generation of each of the pressure waves and the corresponding meniscus vibration velocity of the second embodiment of liquid ejection head according to the present invention. FIG. 19 illustrates the meniscus vibration velocity at specific ejection ports that do not eject liquid when the 64 energy generating elements 12 belonging to the first drive block are driven simultaneously.

As illustrated in FIG. 19, the times when the meniscus vibration velocities of meniscus vibrations that are attributable to wall surface-reflected waves come to respective peaks are concentrated within the range between about 2.0 μs and about 3.5 μs and there is not any meniscus vibration velocity whose peak is found to be equal or close to 5.1 μs, which is the block interval value.

Thus, as a result, just as the liquid ejection head of the first embodiment, when the energy generating elements 12 of this embodiment whose block interval is predefined to be equal to 5.1 μs are driven continuously, the liquid ejection head of the second embodiment can reliably suppress meniscus vibrations attributable to overlapping of wall surface-reflected waves.

Thus, according to the present invention, it is now possible to reliably suppress defective ejections attributable to pressure waves reflected by a wall surface of the common liquid chamber.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of the Japanese Patent Application No. 2015-003182, filed Jan. 9, 2015, which is hereby incorporated by reference herein in its entirety.

What is claimed is:

1. A liquid ejection head comprising:

a substrate having a plurality of pressure chambers formed therein, the pressure chambers having respective ejection ports for ejecting liquid;

a common liquid chamber communicating with the plurality of pressure chambers; and a plurality of energy generating elements arranged respectively in the plurality of pressure chambers to generate energy necessary for ejecting liquid from the respective ejection ports, the liquid being supplied from the common liquid chamber to the pressure chambers, wherein the common liquid chamber has a first surface, the first surface being a wall surface located at a substrate side, and a second surface located vis-à-vis the first surface, the second surface having an inclined portion inclined relative to the first surface by a predefined inclination angle, the liquid ejection head being configured to cause pressure waves generated as a result of sequentially driving the plurality of energy generating elements with a predefined time difference to propagate from respective starting points on the first surface of the common liquid chamber located at the substrate side, the starting points corresponding to the positions of the respective energy generating elements, in a direction perpendicular to the first surface so as to be reflected by the second surface of the common liquid chamber and returned to respective end points on the first surface such that each pressure wave propagates from the starting point to the end point in a propagation time either shorter or longer than the predefined time difference, and wherein the propagation time $t_R$ is determined by $$t_R = \frac{L_1 + \frac{L_1}{\cos\theta}}{c},$$

where $L_1$ is the linear distance from the starting point to the point at which the pressure wave is reflected by the inclined portion, θ is the angle that is equal to twice the predefined inclination angle formed by the first surface and the inclined portion, and c is the velocity of sound in the liquid.

2. The liquid ejection head according to claim 1, wherein the absolute value of the difference between the predefined time difference and the propagation time is greater than a predefined value.

3. The liquid ejection head according to claim 2, wherein the predefined value is 0.5 μs.

4. A liquid ejection head comprising:

a substrate having a plurality of pressure chambers formed therein, the pressure chambers having respective ejection ports for ejecting liquid;

a common liquid chamber communicating with the plurality of pressure chambers; and a plurality of energy generating elements arranged respectively in the plurality of pressure chambers to generate energy necessary for ejecting liquid from the respective ejection ports, the liquid being supplied from the common liquid chamber to the pressure chambers, wherein the common liquid chamber has a first surface, the first surface being a wall surface located at a substrate side, and a second surface located vis-à-vis the first surface, the second surface having an inclined portion inclined relative to the first surface by a predefined inclination angle, the liquid ejection head being configured to cause pressure waves generated as a result of sequentially driving the plurality of energy generating elements with a predefined time difference to propagate from respective starting points on the first surface of the common liquid chamber located at the substrate side, the starting points corresponding to the positions of the respective energy generating elements, in a direction perpendicular to the first surface so as to be reflected by the second surface of the common liquid chamber and returned to respective end points on the first surface such that each pressure wave propagates from the starting point to the end point in a propagation time either shorter or longer than the predefined time difference, and wherein the predefined time difference is 3.8 μs and the inclined portion includes a first inclined portion having an inclination angle of 8°, a second inclined portion having an inclination angle of 45°, the second inclined portion being located remoter from the first surface than the first inclined portion, and a third inclined portion having an inclination angle of 8°, the third inclined portion being located remoter from the first surface than the second inclined portion.

5. The liquid ejection head according to claim 4, wherein the absolute value of the difference between the predefined time difference and the propagation time is greater than a predefined value.

6. The liquid ejection head according to claim 5, wherein the predefined value is 0.5 μs.

7. A liquid ejection head comprising:

a substrate having a plurality of pressure chambers formed therein, the pressure chambers having respective ejection ports for ejecting liquid;

a common liquid chamber communicating with the plurality of pressure chambers; and a plurality of energy generating elements arranged respectively in the plurality of pressure chambers to generate energy necessary for ejecting liquid from the respective ejection ports, the liquid being supplied from the common liquid chamber to the pressure chambers, wherein the common liquid chamber has a first surface, the first surface being a wall surface located at a substrate side, and a second surface located vis-à-vis the first surface, the second surface having an inclined portion inclined relative to the first surface by a predefined inclination angle, the liquid ejection head being configured to cause pressure waves generated as a result of sequentially driving the plurality of energy generating elements with a predefined time difference to propagate from respective starting points on the first surface of the common liquid chamber located at the substrate side, the starting points corresponding to the positions of the respective energy generating elements, in a direction perpendicular to the first surface so as to be reflected by the second surface of the common liquid chamber and returned to respective end points on the first surface such that each pressure wave propagates from the starting point to the end point in a propagation time either shorter or longer than the predefined time difference, and wherein the predefined time difference is 5.1 μs and the inclined portion includes a first inclined portion having an inclination angle of 5° and a second inclined portion having an inclination angle of 45°, the second inclined portion being located remoter from the first surface than the first inclined portion.

8. The liquid ejection head according to claim 7, wherein the absolute value of the difference between the predefined time difference and the propagation time is greater than a predefined value.

9. The liquid ejection head according to claim 8, wherein the predefined value is 0.5 μs.

* * * * *